US005244206A

United States Patent [19]

Clark et al.

[11] Patent Number: 5,244,206

[45] Date of Patent: Sep. 14, 1993

[54] HIP MOUNTED TETHERED BALL POLO-LIKE GAME

[76] Inventors: Kerwin E. Clark; Patricia D. Clark, both of 915 W. Lovers La., Arlington, Tex. 76013-3944

[21] Appl. No.: 11

[22] Filed: Jan. 4, 1993

[51] Int. Cl.[5] ..... A63F 7/00

[52] U.S. Cl. ..... 273/118 R; 273/DIG. 19

[58] Field of Search ..... 273/118 R, 129 R, DIG. 19, 273/414, 58 C

[56] References Cited

U.S. PATENT DOCUMENTS

| | | | |
|---|---|---|---|
| 4,059,271 | 11/1977 | Dupre | 273/DIG. 19 X |
| 4,121,822 | 10/1978 | DiSabatino et al. | 273/DIG. 19 X |
| 5,080,376 | 1/1992 | Lerner et al. | 273/DIG. 19 X |
| 5,083,797 | 1/1992 | Vartija et al. | 273/58 C X |

FOREIGN PATENT DOCUMENTS

| | | | |
|---|---|---|---|
| 1010466 | 5/1977 | Canada | 273/DIG. 19 |
| 2242697 | 3/1974 | Fed. Rep. of Germany | 273/DIG. 19 |

*Primary Examiner*—V. Millin
*Assistant Examiner*—Raleigh W. Chiu
*Attorney, Agent, or Firm*—Michael I. Kroll

[57] ABSTRACT

A hip mounted polo-like game suitable for both indoor and outdoor activity including a belt for placement about the hips of a player. A playing ball is free to move on a playing surface. A tethered ball is attached to the belt so that movement of the players hips will cause the tethered ball to move relative to the playing surface for purpose of striking the playing ball toward a goal.

6 Claims, 3 Drawing Sheets

HIP MOUNTED TETHERED BALL POLO-LIKE GAME

BACKGROUND OF THE INVENTION

1. Field of the Invention

This invention relates generally to games and more particularly to games utilizing a tethered ball for swinging motion by body action.

2. Discussion of the Prior Art

A number of waist mounted and hip mounted tethered ball games have been invented in the past. An example of a waist mounted tethered ball game is illustrated and described in U.S. Pat. No. 4,248,435 wherein upon proper movement of the human body a ball is caused to be moved into a cup. A hip mounted ball game is shown in U.S. Pat. No. 3,610,622 wherein the object is to drop a tethered ball into a basket attached to a human body by manipulation of the body without the use of the hands.

Yet another hip mounted tethered ball game is described in U.S. Pat. No. 4,059,271. A bracket is attached to the hip region of a person. A line is attached at one end to the bracket. A ball is tethered to the opposite end of the line in free swinging fashion. The object of the game is to rotate the tethered ball in vertical circles about its attachment to the bracket by utilizing hip movement.

The games described above have one thing in common. The player stands in one location to move a tethered ball into a target or to move the tethered ball in a prescribed motion.

It is an object of the hip mounted tethered ball game of the present invention to require the person performing the game to coordinate his or her hip movements to move the tethered ball in direction to strike another ball toward a surface goal in a fashion similar to the game polo and to follow the free moving ball towards the goal.

It is another object of the present invention to provide a team sport that may be played indoors or outdoors.

SUMMARY OF THE INVENTION

The hip mounted tethered ball game of the present invention comprises a first or playing ball free to move upon a surface and a second or tethered ball. A flexible interconnecting means is connected at one end to the tethered ball and at the other end to the hip area of a player. Movement of the player's hips will cause the tethered ball to move for the purpose of striking the playing ball toward a goal.

The flexible interconnecting means, in one embodiment, is comprised of cloth or plastic. Preferably, it is an elongate tube or cylinder of net-like material having at least one end closed. The tethered ball is fitted within the tube and placed adjacent the closed end. An opposite end of the cylinder is attached to the hips of the player. The attachment may be by way of tying the opposite end about the hips of the player. In the alternative a belt, with a loop, is tied about the hips of the player and the opposite end of the cylinder is secured to the loop.

In another embodiment the tethered ball has a groove formed in its outer surface and a bar inserted within the groove. An elongate strap either leather or plastic is secured at one end to the bar and an opposite end tied to a belt about the waist of the player.

The playing ball is larger than the tethered ball and lighter in weight.

BRIEF DESCRIPTION OF THE DRAWINGS

The accompanying drawings show, for the purpose of exemplification without limiting the invention or the claims herein, certain practical embodiments illustrating the principles of the invention wherein:

DETAILED DESCRIPTION OF THE INVENTION

Figure 1:
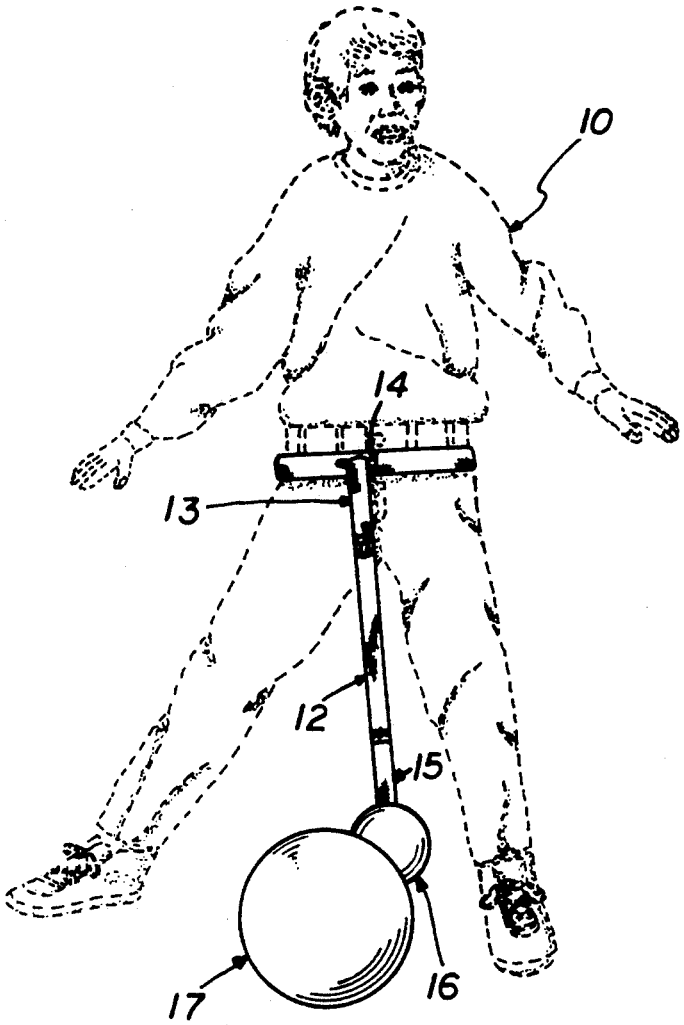
FIG. 1 is a perspective of a player equipped to play the game by striking a playing ball with a tethered ball.
Figure 2:
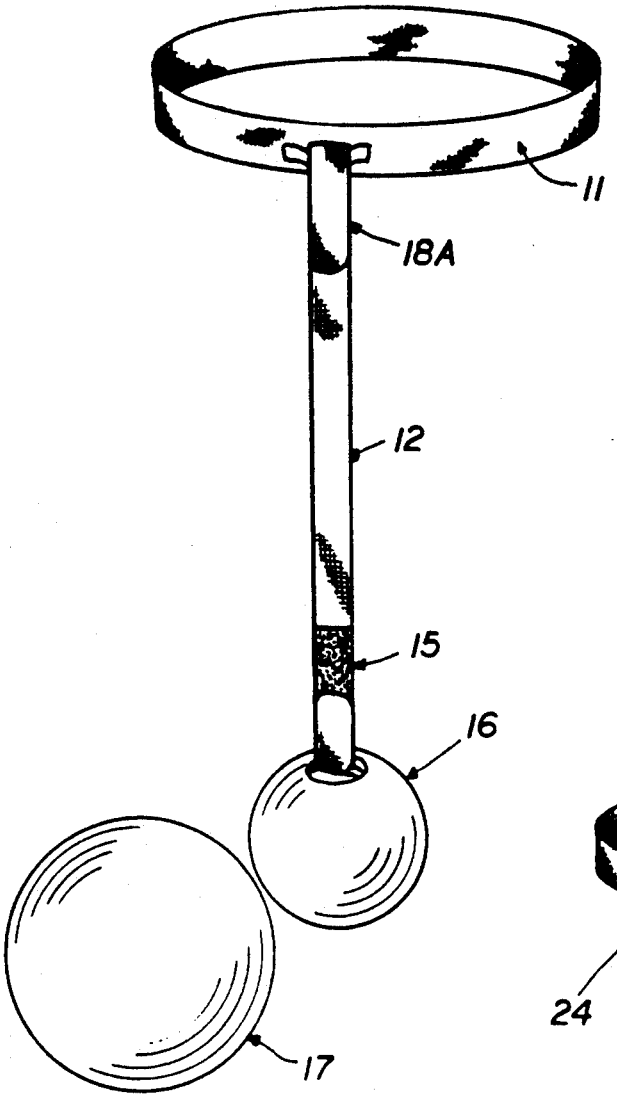
FIG. 2 illustrates in greater detail the apparatus of FIG. 1 wherein a flexible strap is attached at opposite ends to a belt and to a ball moveable by body action of a player.

Referring now to FIG. 1 a person 10 is shown equipped to play the game of the present invention. A belt 11 is secured about the hips of the person 10. A flexible means or tether 12, shown as a strap, has one end 13 secured to a loop 14 formed on the belt 11. An opposite end 15 of the flexible means, a tether, is attached to a contact ball 16. Movement of the players hips will cause the tethered ball 16 to move side to side or back and forth to strike a ball 17, which may be solid or inflated, with the objective of moving it toward a goal.

Figure 4:
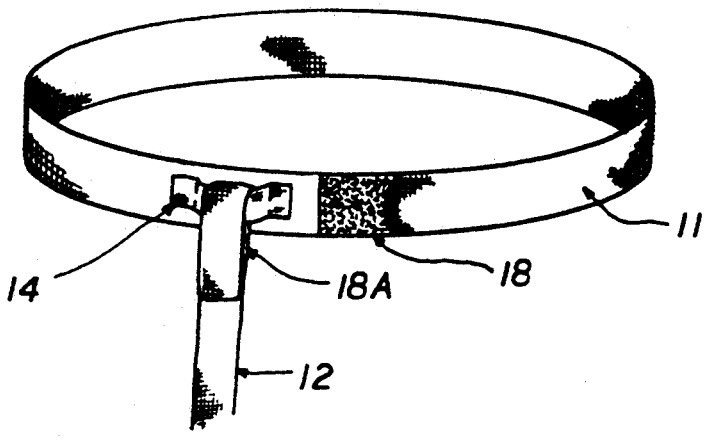
FIG. 4 illustrates a belt having a loop for receiving an end of a flexible strap.
Figure 5:
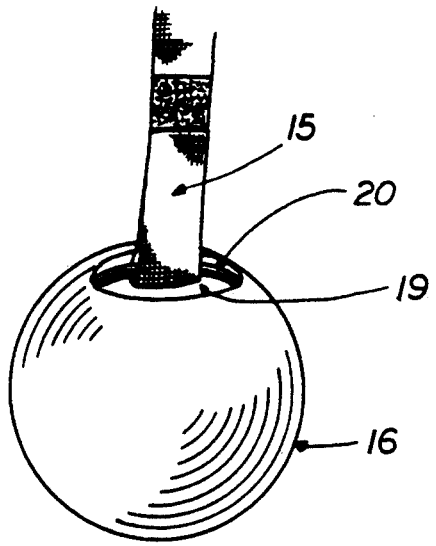
FIG. 5 illustrates in detail a manner of securing an end of a strap to a tethered ball made moveable by body action of a player.

In one embodiment the belt 11, as shown in FIG. 4, is adjustable by the use of material having a surface of tiny hooks and a complementary surface of a clinging pile. This material is available under the trade name VELCRO. The VELCRO material is placed at 18 on the body of the belt and cooperating VELCRO materials added to underside of the free end of the belt at 18. Thus the belt may be adjusted to fit the various hip sizes of the players. The belt 11 is also adjustable in length. When properly fitted on a player the belt length must be such that the tethered ball 16 will be above the surface upon which the game is played. Since the height of a player is variable, provision is made to adjust the length of the tether. As shown in FIGS. 4 and 5, one end of the strap or tether 12 is fed through the loop 14 formed on the belt 11. Velcro material is added to opposing sides of the tether 12 at 18A to fix the tether to the belt 11 and may be of length to adjust the length of the tether. The opposite end 15 of the tether is attached to the ball 16. The ball 16 is provided with a groove or slot 19 across which is formed or fitted a bar 20. The end 15 of the tether is fed around the bar 20 and held in place by Velcro material formed on opposing sides of the end 15. The lengths of the Velcro material are adequate to enable the player to adjust the length of the tether such that the tethered ball 16 will be above the surface played upon.

Figure 3:
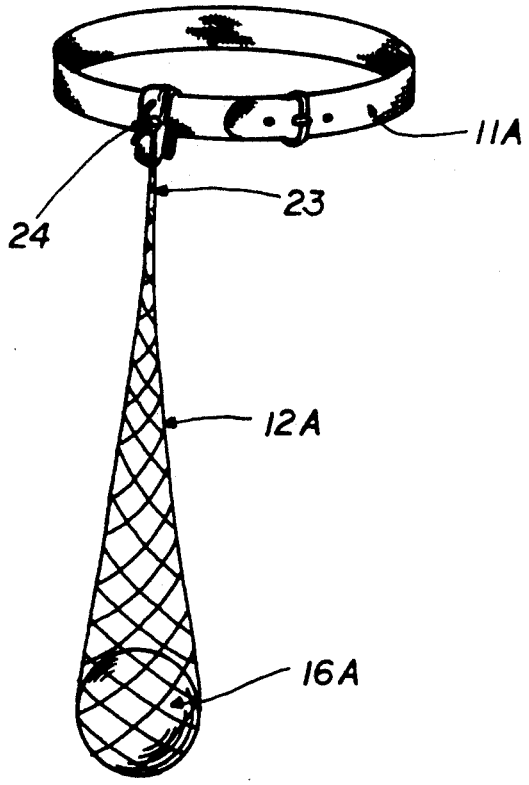
FIG. 3 illustrates the flexible means as a tube or cylinder like material with the tethered ball enclosed at a closed end of the cylinder.

Another embodiment of the invention is shown in FIG. 3. There a belt 11A, to be fitted about the hips of a player, is of the conventional type being made adjustable by way of buckle 21. The tether 12A is preferably comprised of a tube or cylinder of net-like material having at least one closed end at 22. The tether 12A can also be formed of imperforate cloth or plastic having a lower portion to receive the ball 16A. As shown, tethered ball 16A is fitted into the tube or cylinder and located at the closed end 22. The tethered ball 16A may be like tethered ball 16, or may be a ball having a conventional surface free of any attaching means.

Figure 6:
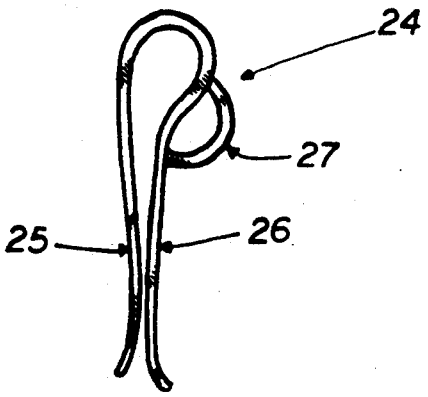
FIG. 6 is a side view of a clip to be mounted to a belt and having a loop for receiving a free end of the flexible means.

The tether 12A may be attached to the hips of a player by tying the end 23 directly about the hips of a player or as shown connected to the belt 11A by way of a clip or hook 24. The clip or hook 24 is shown in FIG. 6 to be comprised of bifurcated structure having legs 25 and 26 urged toward each other. The legs are placed over the belt 11A as shown in FIG. 3 and held in place by the force urging the legs together. The clip or hook 24 includes a loop 27 formed integrally therewith to receive the end 22 of the tether 12A to be tied thereto.

The playing ball 17 is, in one embodiment, an inflated ball, light weight and preferably larger than the tethered ball 16 to provide a larger target for the player. The playing ball 17 may also be solid, made of foamed plastic, or it may be a hollow plastic or rubber ball. The tethered ball 16 is a solid ball having mass to move the playing ball 17 when struck by the tethered ball.

Now that the invention has been described in detail modifications will suggest themselves to those skilled in the art, and it is intended to cover those modifications as which fall within the scope of the appended claims.

What is claimed is:

1. A hip mounted polo-like game for both indoor and outdoor activity comprising:

a playing ball free to move upon a playing surface, a tethered ball, and a flexible interconnecting means having one end connected to said tethered ball and an opposite end for connection to the hips of a player, whereby movement of the player's hips will cause the tethered ball to move relative to the playing surface for purpose of striking the playing ball toward a goal.

2. The hip mounted polo-like game of claim 1 in which said flexible interconnecting means is a tube of net-like material having at least one closed end with the tethered ball placed within the tube at said closed end.

3. The hip mounted polo-like game of claim 1 in which said tethered ball has a bar inset in its outer surface and said interconnecting means is a strap having one end wrapped about said bar to secure it thereto.

4. The hip mounted polo-like game of claim 1 in which said playing ball is an inflated ball of diameter greater than the diameter of said tethered ball and of lesser weight.

5. The hip mounted polo-like game of claim 1 including a belt to be secured about the hips of a player and having means for receiving said opposite end of said flexible means to secure said flexible means to the hips of the player.

6. The hip mounted polo-like game of claim 1 in which said flexible means is adjustable in length to place said tethered ball above the playing surface.

* * * * *